United States Patent [19]

Olson

[11] 4,233,753

[45] Nov. 18, 1980

[54] METHOD FOR PREVENTING THE SPLITTING OF LOGS DURING DRYING

[75] Inventor: Alvin E. Olson, Beaverton, Oreg.

[73] Assignee: Allwood, Inc., Portland, Oreg.

[21] Appl. No.: 5,662

[22] Filed: Jan. 22, 1979

[51] Int. Cl.[3] ..... F26B 5/04

[52] U.S. Cl. ..... 34/16.5; 34/13.4; 34/13.8

[58] Field of Search ..... 34/9.5, 13.4, 13.8, 34/15, 16.5, 17

[56] References Cited

U.S. PATENT DOCUMENTS

| | | | |
|---|---|---|---|
| Re. 4,381 | 5/1871 | Beach . | |
| 1,021,676 | 3/1912 | Howard . | |
| 1,066,523 | 7/1913 | Palen . | |
| 1,190,703 | 7/1916 | Banks | 34/16.5 |
| 1,328,506 | 1/1920 | Fish, Jr. . | |
| 1,328,655 | 1/1920 | Fish, Jr. . | |
| 1,328,657 | 1/1920 | Fish, Jr. . | |
| 1,328,658 | 1/1920 | Fish, Jr. . | |
| 1,328,659 | 1/1920 | Fish, Jr. . | |
| 1,328,661 | 1/1920 | Fish, Jr. . | |
| 1,333,848 | 3/1920 | Jacobs . | |
| 3,921,309 | 11/1975 | Nakayashiki | 34/16.5 |

*Primary Examiner*—John J. Camby

*Attorney, Agent, or Firm*—Chernoff & Vilhauer

[57] ABSTRACT

A method for treating whole logs to prevent them from splitting as they are dried to a desired moisture content. Whole green logs are placed in a pressure vessel which is sealed. Preferably the logs are debarked before they are placed in the vessel, but they may be debarked after their removal therefrom. Steam is thereafter injected into the vessel until the wood throughout the logs has reached a temperature within the range of about 190°-240° F., while condensed water and other fluids from the wood are drained from the vessel. Subsequently the pressure in the vessel is released at a rate slow enough that no significant collapse of the wood within the logs occurs, and when the logs are cool enough to handle they are removed, debarked if necessary, and dried in a room whose relative humidity is maintained not less than about 45% until the logs have reached a predetermined moisture content.

2 Claims, No Drawings

METHOD FOR PREVENTING THE SPLITTING OF LOGS DURING DRYING

BACKGROUND OF THE INVENTION

This invention relates to methods for treating wood and, in particular, a method for treating whole logs to prevent them from splitting as they are dried to a desired moisture content suitable for a particular use.

In the woodworking industry it would often be desirable to form articles out of large, monolithic pieces of wood. For example, in the furniture industry it would be desirable to turn a single piece of wood on a lathe to produce a table leg. Similarly, it would be desirable to produce decorative and useful items such as bowls from a single piece of wood. Typically, the wood used for such applications is hardwood, for example, alder, aspen, maple, dogwood or cherry, due to the density of such woods and the pleasing appearance of their grain and color characteristics.

Once green wood has been cut it ultimately will dry out unless treated to prevent the loss of moisture, and as it dries it will twist, warp and split. This is principally due to the internal stresses naturally produced as wood dries due to the different amounts of shrinkage that occur in respective dimensions of wood as a result of the wood cell structure. More specifically, much greater shrinkage occurs in a dimension tangential to a log than in a radial dimension, and very little shrinkage occurs in the longitudinal dimension, for a given loss in moisture content. Consequently, when a log is left to dry the substantially greater tangential shrinkage causes the log to split inwardly, thereby eliminating its usefulness for most applications, particularly the fashioning of articles from large, monolithic pieces of wood. Moreover, this problem is exacerbated by nonuniform drying of a log whereby the outer portions dry faster than the interior.

The conventional solution to the foregoing problem has been to cut whole logs into lumber and thereafter dry the lumber. The dried lumber pieces may then be laminated together into large pieces which can be worked on a lathe or otherwise to produce furniture parts and other decorative and useful items. However, not only is the conventional approach expensive but the result is less than satisfactory because of the nonuniform appearance of the resultant product.

Cutting logs into lumber overcomes the splitting problem for several reasons. First of all, the usual stresses resulting from drying wood may be reduced as a result of the shape and size of a board cut from a log, and the position that it assumed within the log. For example, a plank whose widest lateral dimension corresponds to a radial dimension of the log from which it was cut will undergo substantially uniform shrinkage in any one of its lateral and longitudinal dimensions, though the amount of shrinkage in any one such dimension will ordinarily be different from the shrinkage in another of those dimensions, so that as the plank shrinks the respective different amounts of shrinkage in those dimensions will not produce splitting or warpage. In comparison, a plank cut near the perimeter of a log with its widest lateral dimension tangential to the log from which it is cut will undergo less uniform shrinkage in its widest lateral dimension and, therefore, will warp somewhat during drying, but it generally will not split if it is thin enough to bend. Another reason is that the smaller size of lumber in comparison to the log from which it is cut facilitates more nearly uniform drying of the wood. In addition, it has been found that through seasoning of lumber by subjecting it to controlled heat during the drying process, for example in a dry kiln, and in some instances to vacuum, pressure or moisture as well, the drying not only can be accellerated but the quality of the lumber can be improved.

For example, Beach U.S. Re. No. Pat. 4384 discloses a method for seasoning lumber wherein it is subjected to steam at 200° to 280° F. under 30 to 40 psi pressure for five to fifteen minutes and thereafter allowed to dry. Other methods for treating wood, primarily lumber, using various combinations of heat, moisture, pressure and vacuum are disclosed in the following patents: Howard U.S. Pat. No. 900,017; Howard U.S. Pat. No. 1,021,676; Palen U.S. Pat. No. 1,066,523; Fish, Jr. U.S. Pat. No. 1,328,506; Fish, Jr. U.S. Pat. No. 1,328,655; Fish, Jr. U.S. Pat. No. 1,328,657; Fish, Jr. U.S. Pat. No. 1,328,658; Fish, Jr. U.S. Pat. No. 1,328,659; Fish, Jr. U.S. Pat. No. 1,328,661; and Jacobs U.S. Pat. No. 1,333,848. However, none discloses a method satisfactory for preventing green, debarked whole logs from splitting as they are dried, in order to produce a large, monolithic piece of wood suitable for woodworking.

SUMMARY OF THE PRESENT INVENTION

The present invention provides a novel method for preventing splitting of debarked whole logs during drying so that the resulting logs can be worked on a lathe or otherwise to produce monolithic furniture parts or other decorative and useful items. It has been found that this method is particularly effective for hardwoods, such as alder, aspen, maple, dogwood and cherry, though it is not necessarily limited to those particular woods and has also been found to be effective, for example, for hemlock, a softwood.

In this method green whole logs are placed in a pressure vessel which is thereafter sealed. Preferably, the whole logs are first debarked since the bark does not serve any purpose in fabricating the wood into useful items and tends to prevent drying, but the logs can be debarked after subsequent removal from the vessel. Steam is injected into the pressure vessel in order to raise the moisture level therein and increase the temperature to about 190°–240° F. Once a suitable temperature within the range is reached, it is maintained, by injecting additional steam as needed, for a long enough time that the temperature of the wood throughout the logs is also increased to 190°–240° F. At the same time, the injection of steam into the vessel subjects the logs to higher than ambient pressure.

Thereafter, the temperature is reduced by releasing the pressure within the vessel slowly. Too rapid reduction of the pressure will produce collapse of wood cells within the logs, and, thus, destruction of the product. Once the inside of the vessel has reached ambient pressure and the logs have cooled sufficiently to handle, the logs are removed from the vessel, debarked if that was not previously done, and placed in a room for air drying.

The logs are placed in the drying room in an orientation such that good air circulation may be achieved. The relative humidity in the room during drying is held nominally at about 55%, but in any case not lower than about 45%, to control the rate of drying. Lower relative humidity will produce more rapid, and perhaps uneven, drying which results in destruction of the product.

Once the logs have achieved the desired moisture content, for example, about 10–12% for furniture parts, they are removed and may be worked upon without the danger of splitting from further drying.

Therefore, it is a principal objective of the present invention to provide a novel and useful method for preventing splitting of logs during drying.

It is a principal feature of the present invention that according to the aforementioned method logs are subjected to increased moisture, temperature and pressure, those factors are subsequently reduced, the logs are debarked, and thereafter the logs are dried under controlled humidity conditions.

The foregoing objectives, features and advantages of the present invention will be more understood upon consideration of the following detailed description of the invention.

DETAILED DESCRIPTION OF THE INVENTION

In the method of the subject patent application green whole logs, that is, entire felled tree trunks or longitudinal sections thereof with or without their bark, are placed in a pressure vessel, commonly referred to as a "retort", preferably such that at least two portions of the outer surface on opposite sides respectively of each log are exposed. Such logs typically have a moisture content of about 100% or more, though the moisture content may not be uniform throughout a given log depending upon the species and the time of year that the log is cut. Preferably the logs are debarked before they are placed in the retort, but this may be done after they are later removed therefrom. Thereafter, the vessel is pressure sealed.

Steam is then injected into the retort to increase the level of moisture therein and raise the temperature therein to approximately 240° F. While it has been found that the method will work at retort temperatures from about 190° F. up to about 240° F., the yield of useful dried logs decreases with temperature and becomes economically inadequate below about 190° F., and unacceptable permanent structural damage to the wood is believed to occur at wood temperatures much greater than about 240° F. It is recognized, however, that a higher temperature might be produced within the retort without raising the wood temperature above about 240° F. The injection temperature of the steam should be higher than the temperature sought to be produced within the retort, for example, about 300° F.

Some time is required for the interior of the retort to heat up to the range of 190°–240° F. Typically, about four hours is required for a retort twelve feet long, having an interior diameter of about 54" and being filled with 80–100 logs of western red alder having 4" nominal diameter (which takes up about 80% of the interior of the retort) to reach 240° F. Once the interior of the retort has been raised to a temperature from 190°–240° F., that temperature should be maintained long enough for all of the logs also to reach 190°–240° F. throughout their wood, and preferably long enough for the temperature throughout the logs to reach the interior temperatures of the retort. For alder logs of 4" nominal diameter and a retort temperature of 240° F. that has been found to be about four hours. The temperature is maintained by injecting additional steam as needed and, at the same time, condensation and natural fluids from the wood are withdrawn from the retort.

As a result of the foregoing steps the pressure within the retort increases, typically to about 15 psi gauge pressure for a temperature of 240° F., though this is not considered a critical amount. Once the temperature has been maintained for the necessary period of time, the injection of steam is stopped and the pressure within the vessel is slowly released. Release of the pressure too rapidly has been found to cause collapse of the wood cells, a commonly known occurrence that results from too rapid withdrawal of free water from within the cells of the wood. Although the acceptable rate of release of pressure from the retort would depend upon many factors such as the wood species, the moisture content of the logs and the temperature of the logs, it has been found that satisfactory results can be achieved for western red alder raised to 240° F. in the aforementioned retort by releasing the pressure of about 1 psi per minute.

After the pressure within the retort has reached ambient pressure and the wood is cool enough to handle, the logs are placed in a drying room. If the logs were not debarked before they were placed in the retort they should be debarked after their removal therefrom and prior to placement in the drying room. Preferably the logs should be stacked in such a manner that they are subjected to maximum air circulation. Satisfactory drying can be achieved by placing the logs parallel to one another in layers, the logs of each layer being oriented perpendicular to those of the adjacent layers. The lower the humidity in the drying room, the faster the logs will dry; however, it has been found that the relative humidity should be maintained no lower than about 45%, beneath which the failure rate of final product, that is the percentage of logs that do split, increases dramatically. The logs should be left to dry under controlled humidity conditions until a desired moisture content within the logs has been achieved, typically a moisture content of 10–12% for the furniture market.

The invention will now be described further by way of the following non-limiting example showing how an acceptable dried wood log may be prepared utilizing the foregoing method.

EXAMPLE

Eighty to one hundred and twenty 4" nominal diameter freshly-cut western red alder whole logs are debarked. These whole logs are then placed in a retort 12' long and 54" in inside diameter, after which the retort is pressure sealed. Steam at 300° F. is injected into the vessel until the temperature inside the vessel reaches 240° F. Thereafter, this temperature is maintained for approximately four hours by injecting additional steam as needed, while water condensation and fluids from the wood are drained from the retort. While this temperature is maintained the internal gauge pressure is approximately 15 psi. Thereafter, the injection of steam is stopped and the pressure within the retort is reduced at about 1 psi per minute until ambient pressure is reached. After the logs have sufficiently cooled to be handled they are placed in a drying room whose relative humidity is maintained at about 55% until such time as the measured internal moisture content of the logs has dropped to 12%.

The terms, expressions and examples which have been employed in the foregoing specification are used therein as terms of description and not of limitation, and there is no intention in the use of such terms and expressions of excluding equivalents of the features described or portions thereof, it being recognized that the scope of the invention is defined and limited only by the claims which follow.

What is claimed is:

1. A method for preventing splitting of whole logs during the drying thereof, comprising:

(a) placing a whole log in a pressure containment vessel and sealing said vessel;

(b) after said vessel is sealed, injecting steam therein until the temperature throughout said log is within the range of about 190° F. through about 240° F.;

(c) thereafter, releasing the pressure within said vessel at a rate sufficiently low that no significant collapse of the wood within said log occurs, until ambient atmospheric pressure is reached;

(d) debarking said log; and (e) after steps (c) and (d), storing said log in an atmosphere controlled to maintain no less than about 45% relative humidity until the moisture content in said log has been reduced to a predetermined amount.

2. The method of claim 1 wherein said steam is injected into said vessel at a temperature higher than 240° F.

* * * * *

UNITED STATES PATENT AND TRADEMARK OFFICE

CERTIFICATE OF CORRECTION

PATENT NO. : 4,233,753

DATED : November 18, 1980

INVENTOR(S) : Alvin E. Olson

It is certified that error appears in the above-identified patent and that said Letters Patent are hereby corrected as shown below:

Col. 3, Line 16 After "more" insert --readily--.

Signed and Sealed this

*Twenty-ninth* Day of *December 1981*

[SEAL]

*Attest:*

GERALD J. MOSSINGHOFF

*Attesting Officer* *Commissioner of Patents and Trademarks*